US005250084A

United States Patent [19]

Lansell et al.

[11] Patent Number: 5,250,084

[45] Date of Patent: Oct. 5, 1993

[54] ABRASIVE TOOLS AND PROCESS OF MANUFACTURE

[75] Inventors: Peter V. Lansell; Ralph D. Collins, both of Melbourne, Australia

[73] Assignee: C Four Pty. Ltd., Preston, Australia

[21] Appl. No.: 920,940

[22] Filed: Jul. 28, 1992

[51] Int. Cl.[5] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| 3,751,283 | 8/1973 | Dawson | 51/293 |
| 4,919,974 | 4/1990 | McCune et al. | 51/293 |
| 5,085,671 | 2/1992 | Martin et al. | 51/309 |

FOREIGN PATENT DOCUMENTS

| | | |
|---|---|---|
| 2648649 | 3/1978 | Fed. Rep. of Germany . |
| 59-31894A | 2/1984 | Japan . |
| 63-121697A | 5/1988 | Japan . |

*Primary Examiner*—Mark L. Bell
*Assistant Examiner*—Willie J. Thompson
*Attorney, Agent, or Firm*—Pillsbury Madison & Sutro

[57] ABSTRACT

A process using predetermined magnetic lines of flux to position, orient, and retain abrasive particles having a magnetic conductive coating thereon to a substrate surface for bonding to the surface by suitable electroplating or other plating processes. The process allows use of high aspect ratio abrasive particles to produce desirable cutting, grinding, and sanding characteristics in a wide variety of tools such as saws, knives, abrasive drums, lapidary disks, and sandpaper, which are also part of the invention. Since the positioning of the abrasive particles can be controlled, various desirable patterns thereof can be produced on substrates of various shapes and sizes especially when the substrate is non-magnetic.

16 Claims, 4 Drawing Sheets

FIG. 1.
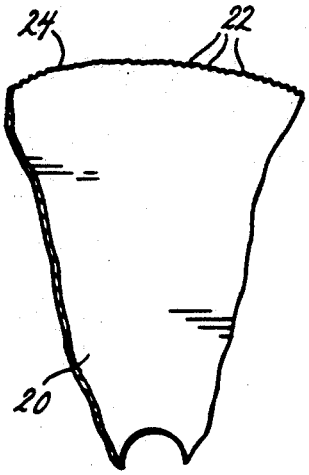
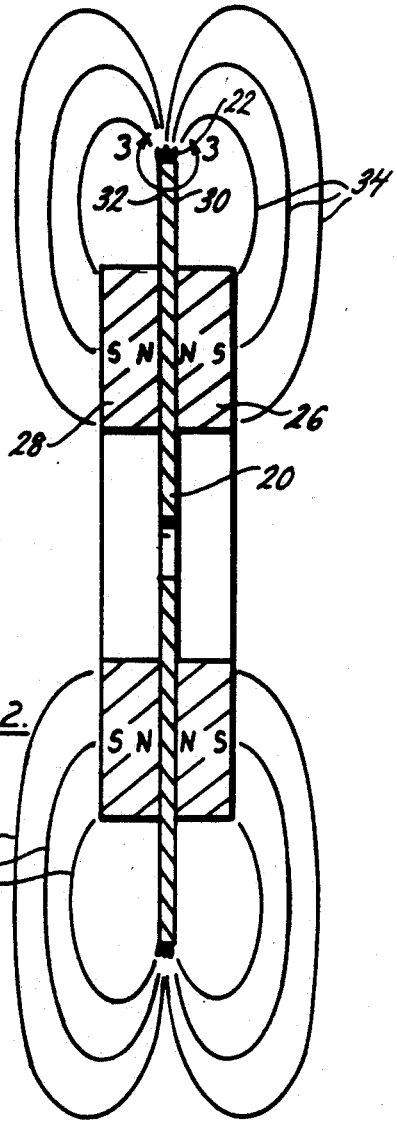
FIG. 2.
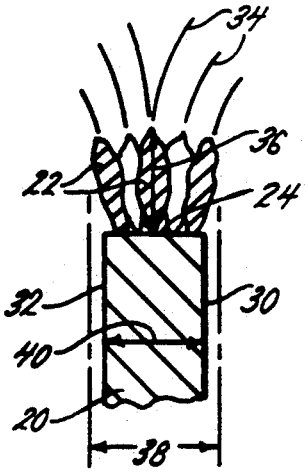
FIG. 3.
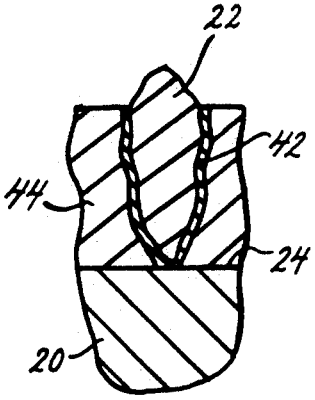
FIG. 4.
FIG. 5.
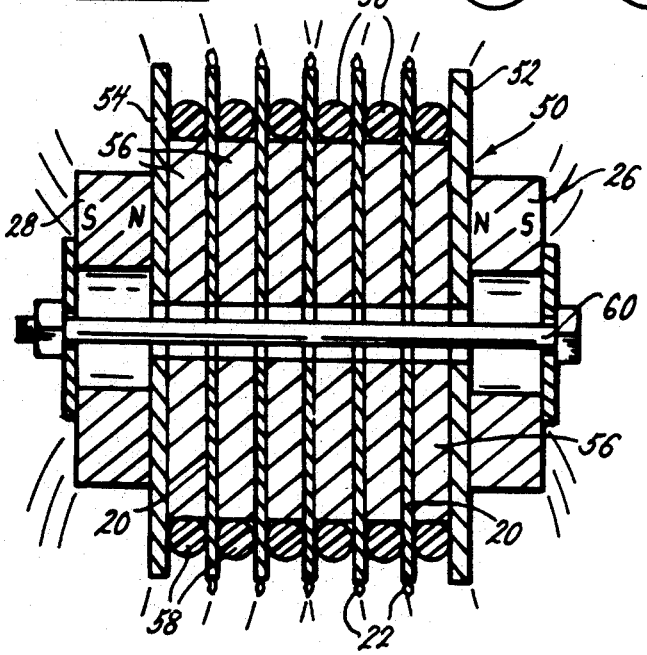
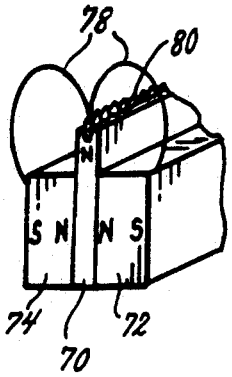
FIG. 6.
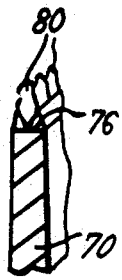
FIG. 7.

ABRASIVE TOOLS AND PROCESS OF MANUFACTURE

TECHNICAL FIELD

Our invention relates to cutting, grinding, sanding and lapping tools having desirably oriented abrasive particles thereon and the process for such orientated attachment.

BACKGROUND ART

Particle abrasives such as diamond, various carbides and oxides are commonly used on grinding, cutting or lapidary tools and flexible abrasives such as sandpaper to provide means to cut, abrade or polish relatively hard materials such as metal, stone or composites. Generally, there has been no suitable process for applying such abrasive particles in other than random orientation and the various attachment means heretofore used are disadvantageous. They tend to operate by physically retaining the particles by imbedding them in a metal matrix, so that when the particles are approximately half worn, they are released from the metal matrix and are lost.

One method of retaining the particulate abrasive is to place the object to be coated in a bed of the particular abrasive, immersed in an electro-plating solution. Unfortunately, this requires a relatively large stock of abrasive particulate, which can be expensive if the particulate is diamond grit. Another method uses occlusion plating in which the particulate abrasive is circulated within a plating solution so that as particles come into contact with a substrate, they are tacked thereon. There are some variations to both of these processes, but in both cases, the article being coated is usually transferred to a second plating tank for finish plating after the initial tacking has occurred, thus requiring two tanks containing essentially identical plating solutions. When diamond grit is used, these processes are particularly disadvantageous, because generally, diamonds have a surface which is difficult to wet in an electro-plating process. Therefore, the plated metal matrix tends to physically retain the diamonds through envelopment rather than establishing a bond with individual diamonds. When tools constructed by these methods are used, there is a very small heat transfer path from the diamond to the substrate, so that the diamond tends to heat during use. The heating, if allowed to continue, causes cracking of the diamonds, or under extreme cases, sublimination and/or oxidation thereof, limiting the speeds and pressures at which such tool may be used.

What happens is that the plated metal, usually nickel, plates on the substrate metal, and builds up around the individual particles of abrasive. Therefore, the abrasive is held mechanically. The thickness of the plating equals roughly sixty percent of the diameter of the diamond. Therefore, it follows that the useful part of the diamond is about forty percent of its diameter, and when wear continues much beyond that point, the diamond is likely to come out. With both bed and occlusion systems, there is no particular orientation of individual grains of abrasive, and the abrasive, in most instances, presents a flat face rather than a sharp corner, as its cutting edge. Using these processes, an individual grain of abrasive is likely to attach to any bare metal surface forming the cathode of an electro-plating process with which it comes into contact. Therefore, control over the placement of abrasive particles is fairly limited.

Improved methods of attaching abrasive particles also includes first coating the abrasive particles electrolessly with a paramagnetic material, such as nickel, nickel phosphorous, cobalt or the like, paramagnetic material being that which is magnetizable but is not necessarily magnetized and is sometimes known as magnetic. The particles can then be attached to the substrate magnetically, either before or after the article to be coated is placed within an electro-plating tank.

All three methods produce a satisfactory result where the abrasive particles are to be distributed relatively evenly over the whole exposed surface. However, such even distribution with random grit orientations is not as desirable as would be possible if the process produced a pattern which controlled interruptions in the abrasive action to promote free cutting qualities of the tool either by allowing abraded material to escape therefrom or to assist any liquid coolant to wash away the debris produced by the action of the abrasing particles.

Existing techniques have produced patterns of abrasive, but they require the use of masks to produce even simple patterns. In addition, individual particles tend to attach to the substrate in a randomly oriented manner. Thus, an elongated particle may attach to the substrate with its axis either parallel or at right angles to the surface. This effect is undesirable. For example, in a saw blade advantage is gained by attaching elongated abrasive particles with the points projecting outwardly, and in lapping plates, a smoother cut is desired and may be obtained by laying the particles down flat.

Therefore, there has been a need for a process to selectively orient and place abrasive particles on a substrate in any pattern desired and/or with any orientation or combinations or orientations which also promotes cooling of the abrasive particles by providing an excellent heat transfer path away therefrom, and which allows the abrasive particles to be retained until they are almost completely worn away.

DISCLOSURE OF INVENTION

In accordance with the present invention an improved process and the products manufacturable thereby, are disclosed. Although diamond particles are described in detail hereinafter, it should be appreciated that any abrasive material which is compatible with electroless plating processes, can be used in the present invention. In the present invention, abrasive particles are electrolessly plated with a material which is magnetic or can be made magnetic through heat treating at temperatures below those which would affect the properties of the particles. Such particles will tend to align themselves with magnetic lines of flux. Therefore, when the present process is used to apply the diamond particles to magnetic materials such as steel saw and knife blades, magnetic flux is applied in such a manner that the lines of flux extend outwardly from the tool with the orientation desired for the longitudinal axis of the particles. Since commercial diamond particles may be obtained which are essentially spherical, or have a relatively large length-to-width ratio, cutting edges can be created on such tools with a wide variation in characteristics. However, for such tools, it is generally desirable to use particles having a large length-to-width ratio which stand-up on the cutting surface because the ends of such particles tend to be sharper and more abrasive than the sides thereof or the surface of more spherical particles.

Where the abrasive particles are to be positioned over a large surface area rather than an edge of a tool, such as in laps, surface grinders, and sandpaper, then a non-magnetic electrically conductive material is preferable for the substrate. Copper and copper alloys are particularly suitable as are other metals and materials that are compatible with electro-plating solutions. It is also possible to use non-conductive substrates by electrolessly plating them, to make their surface conductive prior to attachment of the abrasive particles using an electroplating process.

In both instances, where the abrasive particles are being applied to the edge of a magnetic material or to the surface of a non-magnetic material, means are provided to cause magnetic lines of flux to extend from the surface so that the particles line up therewith as desired. If it is desired to have the particles stand up from the surface, then the magnetic flux is applied so that the lines extend essentially vertically out of the surface of the substrate. When it is desireable to have the particles present their sides, such as in laps, the magnetic flux lines are arranged to come out of the substrate surface and then go back in at an interval essentially the same as the length of the particle, so that the particles tend to lay on the surface. Once the particles are retained by the magnetic force applied thereto, they are put in an electro-plating bath to bond them to the substrate surface. The electrolessly applied coating acts as a wetting agent to provide a better bond than is possible with an electroplating process alone. Since the particles are retained by the magnetic flux during the electroplating by arranging the areas at which magnetic flux lines extend from the substrate, any desired pattern may be produced on the substrate. Typically, the desired magnetic pattern is first imprinted on a suitably shaped piece of flexible plastic magnetic sheet. This sheet is then fixed for the duration of the process to the back surface of the substrate sheet that is to be coated with abrasive particles. The method of attaching these two components may be by mechanical fixture, adhesives, vacuum, or any other means that are convenient to a particular article.

Ideally, the substrate material will be in sheet form, although the process can be adapted for strips, tubes, belts, rings, hollow spheres and the like. In fact, for certain applications, such as in substitution for common sandpaper, screen sheets may be used to allow escape of cutting debris and cleaning through the application of air or other transport medium.

Therefore it is an object of the present invention to provide a process with which it is possible to orient and pattern abrasive particles on a substrate easily and economically.

Another object is to produce tools with abrasive particles uniformally oriented in a desirable manner.

Another object is to produce knives and other cutting tools with diamond abrasive only at the cutting surface thereof.

Another object is to provide common abrasive tools having diamond as the abrasive element in substitution for more commonly used abrasives.

Another object is to provide a process for attaching abrasive material to a substrate in a manner which assures a good heat transfer path from the abrasive particle to the substrate.

Another object is to provide tools having patterns of abrasive particles oriented as desired applied thereto.

These and other objects and advantages of the present invention will be come apparent to those skilled in the art after considering the following detailed specification, together with the accompanying drawings, wherein:

BRIEF DESCRIPTION OF DRAWINGS

FIG. 1 is a cut-away segment of a portion of a saw blade constructed according to the present invention;

FIG. 2 is a cross-sectional view of apparatus used in constructing the saw blade of FIG. 1;

FIG. 3 is an enlarged cross-sectional view taken at line 3—3 in FIG. 2;

FIG. 4 is an enlarged detailed view of an abrasive particle after it has been applied with the process of the present invention and has been used;

FIG. 5 is a fixture similar to the apparatus shown in FIG. 2 used in constructing multiple saw blades with the process of the present invention;

FIG. 6 is a perspective view of apparatus used in constructing a linear knife edge in accordance with the present invention;

FIG. 7 is an enlarged cross-sectional view of the knife edge of FIG. 6 after completion of the present process;

BEST MODES FOR CARRYING OUT THE INVENTION

Figure 9:
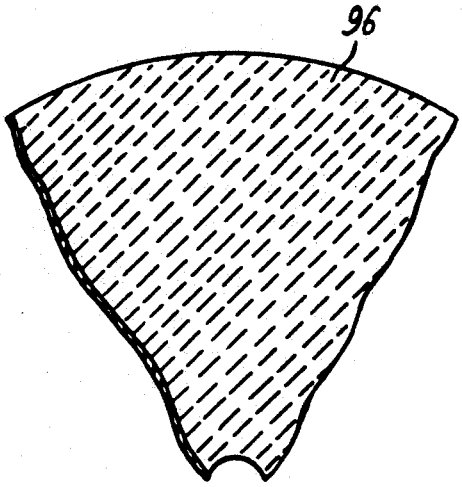
FIG. 9 is a segment of patterned magnetic material utilized to produce the desired magnetic flux lines in the lapidary plate of FIG. 8 during its construction.

Referring to the drawings more particularly by reference numbers, number 20 in FIG. 1 refers to a circular saw blade, a segment of which being shown having abrasive particles 22 such as diamond, cubic boron nitride, titanium nitride, titanium carbide and tungsten carbide attached to its outer edge 24. The saw blade 20 is manufactured by first electrolessly plating the particles 22 with a magnetic material such as nickel phosphorous alloy, cobalt or iron. The blade 20 thereafter is placed between a pair of ring magnets 26 and 28 with similar poles of the magnet, shown as North poles, in contact with the sides 30 and 32, respectively, of the blade 20. This causes magnetic lines of flux 34 to extend generally perpendicular from the outer edge 24 of the blade 20. When the particles 22 with their paramagnetic coatings are placed in the vicinity of the saw blade 20, they tend to align themselves with the lines ,of magnetic flux as shown in FIG. 3. If the particles 22 are those having other than a spherical shape, the long or longitudinal axes 36 thereof, tend to align with the lines of magnetic flux 34 so that the particles 22 are upstanding on the edge 24. Since the lines of magnetic flux 34 adjacent the sides 30 and 32 are not exactly perpendicular to the edge 24, the particles 22 adjacent the sides 30 and 32, tend to slant outwardly providing a cut width, shown by arrows 38, that is wider than the thickness 40 of the blade 20, so that the blade 20 does not tend to bind when cutting.

The magnetic lines of flux 34 hold the particles 22 as shown in FIG. 3 and while the blade 20 is subjected to an electro-plating process which securely bonds the particles 22 to the edge 24 of the blade 20 in these magnetically determined orientations. This is shown in FIG. 4, wherein a particle 22 with its electrolessly plated magnetic and conductive coating 42 is shown along with the electro-plated material 44. The electro-plating process actually coats the entire abrasive particle 22, but when it is first used, both plating material 44 and coating 42 is quickly abraded as shown in FIG. 4.

In the case of the saw blade 20, it is desirable that the blade itself be constructed from materials such as steel, which are magnetizable, since a circular saw blade 20 through the use of the ring magnets 26 and 28 can be caused to produce the desired shape and orientation of magnetic flux lines to orient the particles 22 in the desired upstanding orientation.

Production apparatus 50 for producing multiple saw blades 20 is shown in FIG. 5. In apparatus 50, the ring magnets 26 are positioned on the outside of steel end plates 52 and 54, having sandwiched therebetween alternatively cylindrical steel spacers 56 and saw blades 20. 0-rings 58 are placed around each of the cylindrical steel spacers 56 so that once the particles 22 are magnetically retained on the outer edges 24 of the blades 20, the electro-plating process can secure them without unnecessarily plating large expanses of the sides 30 and 32 of the blades 20. Since the ring magnets 26 and 28 are positioned with alike poles facing and repelling each other, a non-magnetic through-bolt 60 is used to releasably retain the entire apparatus 50 together, allowing the blades 20 to be released once the particles 22 are bonded to the outer edges 24 thereof.

As aforesaid, the particles 22 may be abrasive, such as diamond grit or powder, cubic boron nitride, titanium nitride, titanium carbide, tungsten carbide, or mixtures thereof. Diamond grit is generally preferred, so long as iron is not going to be cut with the blade 20, since at the temperatures that are generated when cutting, iron and the carbon in diamond combine to chemically destroy the diamond. The paramagnetic coating electrolessly applied may be nickel, cobalt or iron. Typically, when diamond particles are used, they are used in sizes which fall in the range of 10 to 2,000 microns, and the paramagnetic coating generally is applied to a thickness in the range of 5 to 30 microns. The coated particles 22 may be subjected to heat treatment to increase the magnetic permeability of the paramagnetic coating. This is especially effective when nickel is included in the coating. Heating to a temperature in the range of 300° to 500° C. for a period greater than ten seconds will generally give satisfactory results. After the lines of magnetic flux 34 are used to secure the particles where desired, electro-plating, such as in a sulphamate nickel bath may be accomplished.

The following example illustrates a preferred method of performing the inventive process.

EXAMPLE 1

30-micron Grade A.M.B. natural industrial diamond grains were first individually plated using a conventional electroless nickel process, such as is available from Enthone-OMI or MacDermid, Incorporated of Waterbury, Conn. The diamonds were prepared by sensitizing in Enplate sensitizer 432 and activated with Enplate activator 440. An electroless nickel coating, in this case MacDermid Catnip 10, was then applied to a thickness of approximately 10 microns. The electroless nickel encapsulated the individual diamond grains and in the as-plated state, formed a paramagnetic coating.

To increase the magnetic permeability of the coating, the diamonds were heat treated by placing them in a reducing atmosphere (propane) and heated in an electric muffle to 400° C. After attaining this temperature, the diamonds were allowed to cool naturally to room temperature. The coated grains were then magnetized by placing them in strong magnetic field. The article to be diamond coated, in this case, the cutting edge of a 90 mm diameter by 0.03 mm thick lapidary saw, was prepared by attaching two ring magnets to its side and masking with lacquer the areas not required to be plated. The assembly was then electro-cleaned by making it the cathode in a commercial, electro-cleaning bath, in this case, MacDermid Metex.S 142. After rinsing, the assembly was electro-etched by making it the anode in a 50% sulfuric acid solution for approximately one minute. It was then rinsed and electro-plated for about twenty minutes in a sulphamate nickel bath in order to provide a good base for subsequent operations. The assembly was then rinsed and dried. The edge of the saw blade was then brought into close proximity to the coated diamond grains. It was observed that the diamonds were magnetically attracted to the blade and became positioned on the extreme periphery thereof. Individual diamonds tended to stand on end, thus presenting sharp corners on the cutting edge. The assembly was then electro-cleaned, rinsed, etched and rinsed as before, taking care not to disturb the magnetically attached diamonds.

The assembly was then returned to the sulphamate nickel plating bath and plating was commenced. After about an hour, it was found that the diamonds had tacked to the saw blade. Electro-plating continued until the thickness of the deposit was judged to be about 150 microns thick, or about the diameter of the diamonds. The assembly then removed from the plating tank, rinsed and dried.

Microscopic examination showed that the nickel plating had encapsulated the diamond grains, bonding them well to the blade and leaving the clearance between individual grains. It is considered that this clearance contributes greatly to the free-cutting properties of the saw blade. In the as-plated state, it was seen that the outer-most points of the diamonds were completely covered with nickel, and although this would wear off quickly when the blade was in use, a decision was made to remove this unwanted part of the plating at the manufacturing stage. The method to remove the plating at the outer peripheries of the diamonds was to electropolish the nickel anodically in a 50% sulfuric acid bath. This had the effect of preferentially removing high spots off the plating, in this case, the points of the diamonds. Electro-polishing continued for several minutes until the points of most of the diamonds were well exposed. The saw blade was then ready for use.

EXAMPLE 2

In further experiment, five saw blades were assembled in the fixture shown in FIG. 5, with 3 mm thick steel spacers between the blades and steel end plates at each end. Ring magnets were attached to the steel end plates as shown, and the whole assembly was bolted together. Silicone O-rings were fitted over the spacers in order to seal off the parts of the saw blades not requiring plating. Other parts of the assembly were masked with lacquer as before, although epoxy-powder coating or plastic dipping would have been satisfactory.

When the electroless, nickel coated, magnetic diamond grains were brought in close proximity of the saw blade edges, it was seen that the diamonds attached magnetically as before. Because the rim of each blade had North magnetic polarity, the previously magnetized diamonds tended to attached with their South poles on the blade and their North poles pointing away. As all of these small magnetic poles of like polarity were repelled by a relatively large of magnetic force of the same polarity on adjacent sides, the diamonds tended to orient themselves in an ideal position, standing on their ends on the extreme edge of the blade. It is considered that a similar method of blade assembly to that described could be used in a production process. Electromagnetics could be used in place of permanent magnets and although the blade edges were made magnetically North in the experiment, it is likely that the process would work well if the blade edges were magnetically South. It would also be possible to make an individual blade a permanent magnetic on its own for the duration of the process, demagnetizing it after the diamonds were held on by the plating.

In FIG. 6, a method of producing a linear knife blade 70 is shown. The blade 70 is sandwiched between elongated bar magnets 72 and 74 having similar poles, in this case North poles, facing the blade 70. This causes the outer edge 76 of the blade 70 to be magnetic North with flux lines 78 extending perpendicular to the surface 76. When the width of the surface 76 is chosen to approximate the width of the abrasive particles 80 applied thereto, the particles 80 tend to line up in a single row as shown in FIG. 7. The particles 80, which may be diamond grains as small as 5 microns, produce a very sharp, very fine saw edge which can cut through meat and vegetables with ease and smoothness not accomplishable in other manners. Care must be taken when using such a knife 70 however, that the material being cut is positioned on wood, plastic or other relatively soft and cheap material, since such a knife 70 can easily cut China plates, scratching or destroying them.

Once the particles 80 are oriented as shown in FIG. 7, the electro-plating process as above-described, is utilized to bond them permanently in position.

Figure 8:
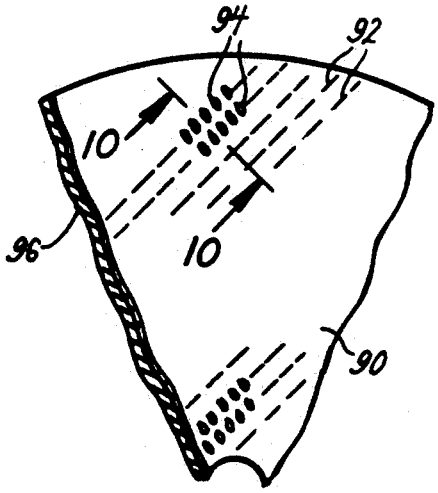
FIG. 8 is a front view of a lapidary plate during its construction utilizing the process of the present invention.
Figure 10:
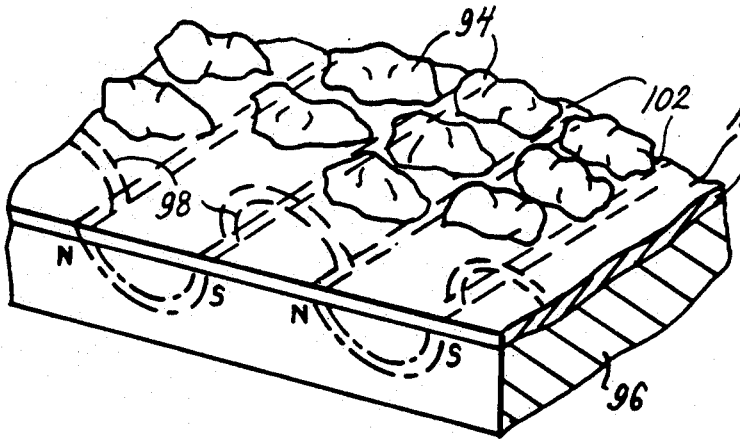
FIG. 10 is a greatly enlarged cross-sectional view taken at line 10—10 in FIG. 8.
Figure 11:
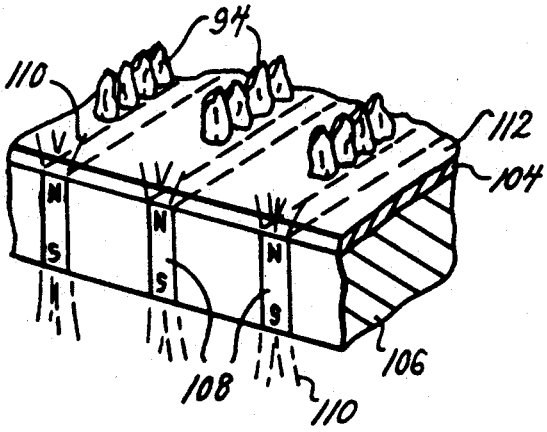
FIG. 11 is a view similar to FIG. 10 showing the effect of different magnetic orientations in the magnetic material of FIG. 9.

FIG. 8 shows a lapidary disc 90 constructed according to the present invention. In the case of the disc 90, it is desirable to produce a magnetic pattern 92 to retain magnetically coated abrasive particles 94 in particular orientations. The substrate material of the lapidary disc 90 should be conductive, but non-magnetic so that means such as refrigerator magnetic material 96 shown in FIG. 9, can be used to impress a magnetic pattern therethrough. An enlarged cross-sectional view taken at lines 10—10 of FIG. 8 is shown in FIG. 10, wherein the semi-cylindrical configuration of magnetic material is shown producing magnetic flux 98 generally parallel to the surface 100 of the substrate 90, causing the abrasive particles 94 to orient themselves across rows 102 on the substrate surface 100. To produce a modified lapidary disc 104 with upstanding particles 94, magnetic material is used having vertical dipole bars 108 which produce magnetic flux lines 110 which extend generally perpendicular to the surface 112 thereof, to cause the upstanding of the particles 94.

Figure 12:
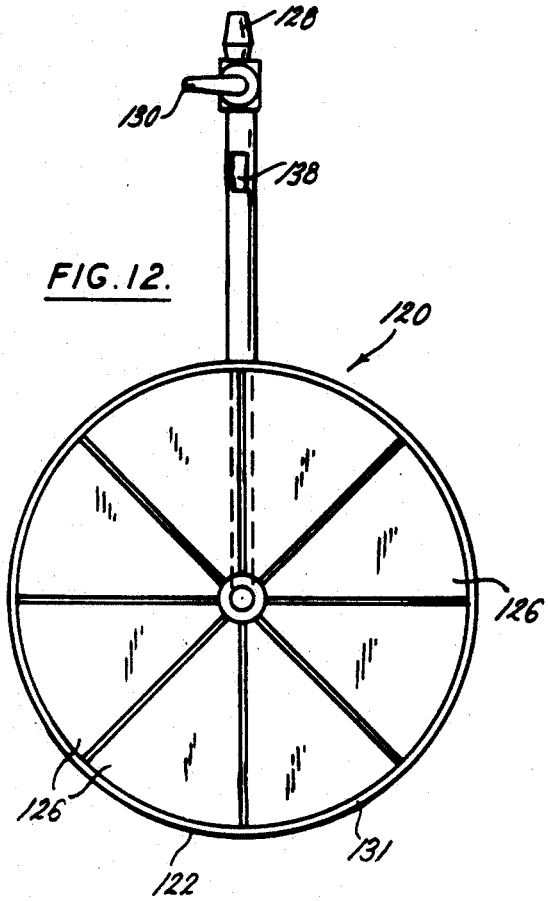
FIG. 12 is a front view of apparatus used in constructing the lapidary plate of FIG. 8.
Figure 13:
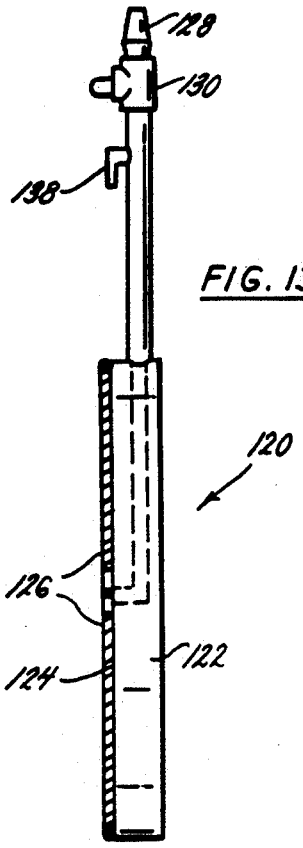
FIG. 13 is a side view of the apparatus of FIG. 12.
Figure 14:
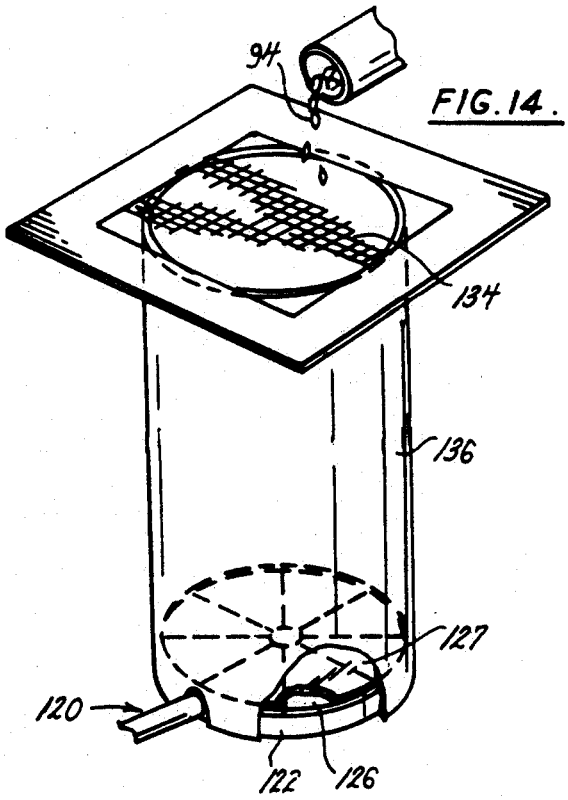
FIG. 14 illustrates the use of the apparatus in FIGS. 12 and 13, during the present process.
Figure 15:
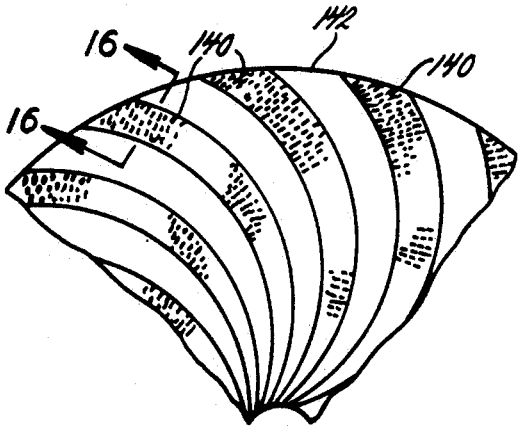
FIG. 15 shows a portion of a modified lapidary plate having a complex pattern thereon.
Figure 16:
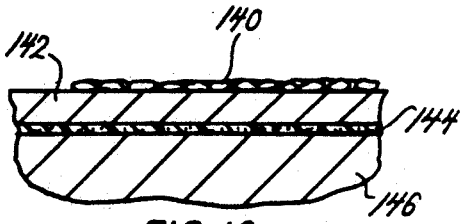
FIG. 16 is a cross-sectional view taken on line 16—16 of FIG. 15.

Typical jig apparatus 120 to produce the discs 90 or 104 is shown in FIGS. 12, 13 and 14. The jig apparatus 120 shown in FIGS. 12, 13 and 14 includes an acrylic base 122 shaped generally like lapidary discs to be manufactured thereon. The acrylic base 122 includes a front surface 124 on which magnetic sheets, such as refrigerator magnets, are fastened, such as with adhesive. As shown, the magnetic sheets are formed into segments 126 which eventually will produce a spoked pattern on the final lapidary disc. A non-magnetic lapidary disc substrate 127 is then positioned on the segments 126 and a vacuum is drawn thereon by means of vacuum line connection 128 and a valve 130. An 0-ring 131 positioned near the periphery may be employed to ensure a good seal. Once vacuum is retaining the disc 127 as shown in FIG. 14, abrasive particles are sprinkled onto the substrate 127. To assure an even distribution, an aluminum screen 134, elevated off of the substrate 127 by a tube 136, can be employed. The abrasive particles 94 are retained to the substrate 127 by the lines of magnetic flux creating the pattern shown in FIG. 8. Thereafter, the apparatus 120 is placed in an electro-plating process hanging by hook 138 until the abrasive particles 94 are securely bonded to the substrate 127. By cutting the magnetic material in patterns other than the simple segments shown, complex shapes such as the spiral arms 140 of lapidary disc 142 of FIG. 15, can be created. It should be noted that by orienting the magnetic material in different directions in each spiral strip, the abrasive particles 94 can be aligned in different horizontal relationships as is desired for particular types of lapidary discs. As can be seen in FIG. 16, the lapidary disc 142 is relatively thin. It normally being retained by means such as an adhesive layer 144 to a thick metal plate 146 for use.

EXAMPLE 3

Diamond particles were prepared with a paramagnetic coating as described above. Flexible plastic magnetic sheeting approximately 1.25 mm thick, was then cut into segments. This material is available commercially, already magnetized in a number of different patterns. The plastic, magnetic segments were then glued to an electro-plating jig, a 200 mm diameter by 0.35 mm thick phosphor bronze disc was fastened over the magnetic sheeting by drawing a vacuum thereon. By drawing the phosphor bronze disc down against an O-ring, it remained firmly in place during the following procedure.

The surface of the bronze disc was first cleaned and then the assembly was hung as the cathode in a sulphamate nickel electro-plating bath for seven minutes at 3 amps to provide a nickel stripe plate. The assembly then was removed from the electro-plating bath, rinsed and dried. A clear acrylic tube 205 mm internal diameter by 500 mm long, was used to space screening plate having rectangular perforated holes 10 mm square therein, above the bronze disc and the diamond particles were sprinkled therethrough. A pattern corresponding to the size and shape of the magnetic segments was then drawn onto the top side of the screening plate and a piece of 180 micron screening cloth was glued to the underside. The application of the coated diamond particles to the surface of the bronze disc proceeded as follows.

The jig plate assembly was placed on a table with the surface of the bronze disc facing upwardly. The acrylic tube was place vertically over the assembly, the screening was then placed cloth-side down on the top of the acrylic tube. The coated diamonds were put into a small bottle with an opening of about 40 mm diameter and a piece of 180 micron screening cloth was then fastened over the opening of the bottle. The diamonds were then applied to the bronze disc by manually shaking them from the bottle and onto the screening plate. It was found that the diamonds fell through the screening plate onto the bronze disc undisturbed by air currents and that an even distribution of particles was readily obtained. The pattern previously drawn on the screening cloth was of great assistance in determining where the diamonds should be applied to the screening plate in order for them to fall evenly to the bronze disc. It was further observed that the diamonds were attached to the pattern of magnetic lines of force existing on the upper surface of the bronze disc due to the presence of the magnetic sheet immediately below the bronze disc. Upon removal of the screening plate and the acrylic tube, it was found that the diamond particles were held sufficiently well by the magnetic attraction to the bronze disc to allow subsequent electro-plating operations to proceed.

The diamond coated surface was then sprayed with a fine mist of water./detergent solution. This was done to help prevent the diamond particles washing off the surface during the next operation which was an anodic etch in a 50% $H_2SO_4$ solution. The plating jig assembly was immersed solely into this acid bath, care being taken not to dislodge the diamond particles. The assembly was then etched at 4 volts for about 20 seconds.

After rinsing, the assembly was hung as the cathode in a sulphamate nickel electro-plating bath. Electroplating proceeded for one hour at 1.5 amps, and then a further three hours at 4 amps, after which time the assembly was removed from the tank, rinsed and dried.

Examination under a microscope showed that the diamond grains were lying down horizontally to the surface and at right angles between the alternate North and South magnetic lines of force in a sharp, well defined pattern. It was further observed that the electroplated nickel had completely encapsulized individual diamond particles leaving them firmly bonded to the substrate with a clearance around them beneficial to a free cutting action of the abrasive particles. The tops of the diamond particles were coated with nickel, and although this part of the coating would wear off rapidly when the disc was first used, a decision was made to expose the tips of the diamond particles by rubbing over the surface of the disc with a small aluminum oxide abrasive stone. The assembly was then cleaned and lightly etched anodically in a 50% $H_2SO_4$ bath for about 20 seconds at 6 volts. After rinsing, the assembly was hung as the cathode in a bright nickel plating bath for 25 minutes at 6 amps. After rinsing and drying, the disc was removed from the electro-plating jig and was considered to be ready for use.

Figure 17:
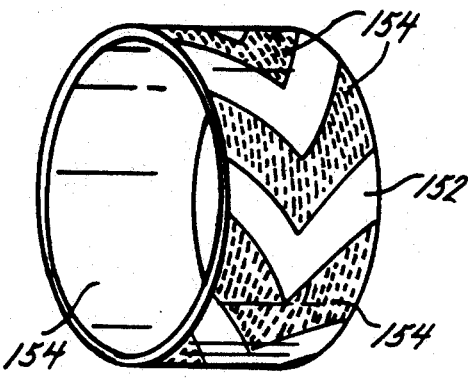
FIG. 17 is a perspective view of an abrasive ring constructed in accordance with the present invention.
Figure 18:
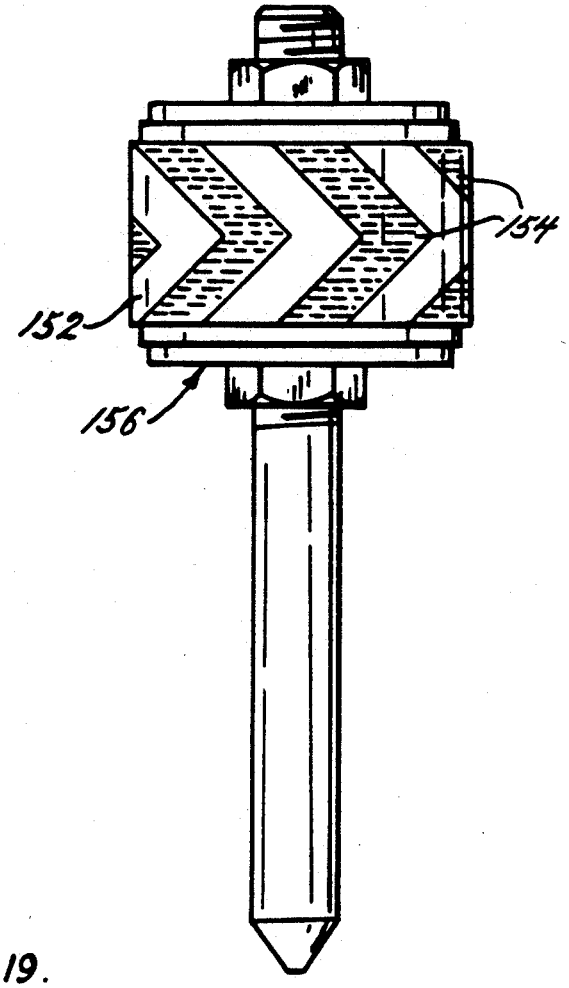
FIG. 18 illustrates the use of the abrasive ring of FIG. 17 on a mandrel.

The present process can be used to produce abrasive patterns on various shapes on substrates. For example, in FIG. 17, herringbone patterns 150 are applied to the outer surface 152 of a ring-shaped substrate 154, such as is useful in substitution for a sanding drum utilized on the mandrel 156, shown in FIG. 18.

Figure 19:
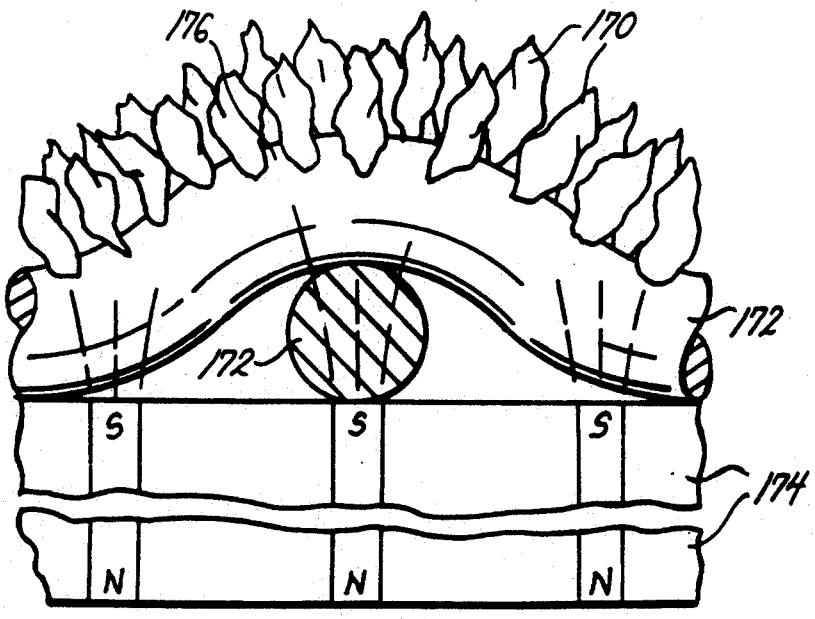
FIG. 19 illustrates the process of the present invention being used to attach abrasive particles to a substrate screen.

FIG. 19 shows a still further use of the present process to provide a useful abrasive product. In FIG. 19, particles of abrasive 170 are applied to a screen mesh 172 again using a patterned magnetic material 174 to produce lines of magnetic flux on which the magnetically coated particles 170 can align prior to electro-plating. In some instances, the screen 172 will be bonded together during the electro-plating process. To prevent this, the screen 172 can be partially embedded in a rubberized backing (not shown) so that only the humps 176 of the screen 172 extend outside the backing for electroplating.

Thus, there has been shown and described a novel process and products produced thereby for attaching abrasive particles to a substrate which fulfill all of the objects and advantages sought therefore. Many changes, alterations, modifications and other uses and applications of the subject process and products will become apparent to those skilled in the art after considering the specifications together with the accompanying drawings and claims. All such changes, alterations and modification which do not depart from the spirit and scope of the invention are deemed to covered by the invention, which limited only by the claims which follow.

We claim:

1. A process for retaining abrasive particles to a substrate having an electrically conductive surface including:

coating the abrasive particles with an electrically conductive magnetic material;

controllably impressing a magnetic field through the electrically conductive surface of the substrate so that lines of magnetic flux extend therefrom applying the abrasive particles coated with electrically conductive magnetic material to the electrically conductive surface of the substrate so that the abrasive particles are retained by the lines of magnetic flux extending from the electrically conductive surface; and electroplating the electrically conductive surface of the substrate and the abrasive particles coated with electrically conductive magnetic material until sufficient plating material is deposited to retain the abrasive particles coated with electrically conductive magnetic material to the substrate in the orientation as established by the lines of magnetic flux.

2. The process as defined in claim 1 wherein the abrasive particles are chosen from at least one of the group consisting of:

diamond;

cubic boron nitride;

titanium nitride;

titanium carbide;

tungsten carbide, and the coating thereof being accomplished with an electroless plating process.

3. The process as defined in claim 2 wherein the electroless plating process coats the abrasive particles with a paramagnetic alloy having as at least one constituent, material consisting of:

nickel;

cobalt; or iron.

4. The process as defined in claim 1 wherein the electroless plating process coats the abrasive particles with a nickel alloy, said process including the further step of:

heat treating the abrasive particles coated with nickel alloy to increase the magnetic permeability thereof.

5. The process as defined in claim 1 wherein each of the abrasive particles has a longitudinal axis and a width, the longitudinal axis thereof being larger than the width, whereby when coated with electrically conductive magnetic material and exposed to lines of magnetic flux, the longitudinal axes of the abrasive particles align with the lines of magnetic flux to which they are exposed.

6. The process as defined in claim 5 wherein the magnetic field is impressed through the electrically conductive surface of the substrate by placing a plastic material having magnetic particles therein whose magnetic domains are in orientations and in a pattern to controllably impress the magnetic field through at least the electrically conductive surface of the substrate with a orientation and pattern, thereby orienting the abrasive particles with orientations and in a pattern similar to the pattern of the magnetic field.

7. The process as defined in claim 1 wherein each of the abrasive particles has a longitudinal axis and a width, the longitudinal axis thereof being larger than the width, whereby when coated with electrically conductive magnetic material and exposed to lines of magnetic flux, the longitudinal axes of the abrasive particles align with the lines of magnetic flux to which they are exposed, the substrate being at least paramagnetic, having lines of magnetic flux extending generally perpendicular to the substrate and the substrate having a width that is about the width of the abrasive particles, whereby the abrasive particles line up generally in single file on the substrate.

8. The process as defined in claim 1 wherein the substrate is a cutting blade having walls on opposite sides of a substrate surface and wherein each of the abrasive particles has a longitudinal axis and a width, the longitudinal axis thereof being larger than the width, whereby when coated with electrically conductive magnetic material and exposed to lines of magnetic flux, the abrasive particles align their longitudinal axes with the lines of magnetic flux to which they are exposed and are retained to the substrate surface, the substrate being at least paramagnetic, having lines of magnetic flux extending from the substrate surface and curving back to the opposite walls, and having a width that is about the length of the longitudinal axis of the abrasive particles, whereby the abrasive particles extend generally perpendicular to the substrate surface at the center thereof and slightly outwardly at the edges adjacent the opposite walls thereof so that the abrasive particles cut a slot wider than the width of the substrate surface between the walls when the cutting blade is used.

9. The process as defined in claim 8 wherein the substrate surface is circular and the magnetic lines of flux are generated by a pair of ring magnets positioned on the opposite walls of the substrate.

10. The process as defined in claim 9 wherein multiple similar substrates are sandwiched between the ring magnets with spacers therebetween during the particle application and electroplating steps, the process further including the step of:

selectively exposing the circular substrate surfaces during electroplating.

11. The process as defined in claim 1 wherein the substrate is relatively thin and non-magnetic.

12. The process as defined in claim 11 wherein the substrate is ring shaped.

13. A tool for removing material from a body of material by moving abrasive particles retained thereto against the body of material, said tool having:

at least one electrically conductive surface; and a plurality of abrasive particles retained to said surface, said tool being constructed by:

plating said abrasive particles with a electrically conductive magnetizable material;

impressing a magnetic field through said electrically conductive surface of said tool so that lines of magnetic flux extend therefrom;

applying said abrasive particles plated with electrically conductive magnetizable material to said electrically conductive surface of said tool so that said abrasive particles are retained along the lines of magnetic flux extending therefrom; and electroplating said electrically conductive surface of said tool and said abrasive particles plated with electrically conductive magnetizable material until sufficient plating material is deposited to retain said abrasive particles plated with electrically conductive magnetizable material to said electrically conductive surface.

14. The tool as defined in claim 13 wherein said abrasive particles are chosen from at least one of the group consisting of:

diamond;

cubic boron nitride;

titanium nitride;

titanium carbide;

tungsten carbide, and the plating thereof being accomplished with an electroless plating process.

15. The tool as defined in claim 14 wherein the electroless plating process plates said abrasive particles with a paramagnetic alloy having as at least one constituent, material consisting of:

nickel;

cobalt; or iron.

16. The tool as defined in claim 13 wherein the electroless plating process plates said abrasive particles with a nickel alloy, said process including the further step of:

heat treating said abrasive particles coated with nickel alloy to make said nickel alloy magnetizable.

* * * * *